United States Patent [19]

Yamada

[11] Patent Number: 4,865,459

[45] Date of Patent: Sep. 12, 1989

[54] HOMOGENIZING MIXER

[75] Inventor: Katsumi Yamada, Mie, Japan

[73] Assignee: Chuorika Co., Ltd., Yokkaichi, Japan

[21] Appl. No.: 200,907

[22] Filed: Jun. 1, 1988

[30] Foreign Application Priority Data

Dec. 18, 1987 [JP] Japan ..... 62-318995

[51] Int. Cl.[4] ..... B01F 5/12

[52] U.S. Cl. ..... 366/270; 366/176

[58] Field of Search ..... 366/262, 263, 264, 265, 366/266, 270, 176, 302, 303, 307

[56] References Cited

U.S. PATENT DOCUMENTS 1,720,549 7/1929 Gilchrist ..... 366/270

2,963,281 12/1960 Reiffen ..... 366/270

*Primary Examiner*—Robert W. Jenkins

*Attorney, Agent, or Firm*—Armstrong, Nikaido, Marmelstein, Kubovcik & Murray

[57] ABSTRACT

A homogenizing mixer for stirring and homogenizing liquids such as paints, printing inks, foodstuffs, medicines and cosmetics. The homogenizing mixer has a stirring unit comprising an upper casing, a lower casing fixedly joined to the upper casing, a fixed shearing plate fixedly held between the upper casing and the lower casing, a rotary shearing disk fixedly mounted on a rotary shaft having a lower end extending within the stirring unit and an upper end operatively connected to driving means, so as to be positioned under the fixed shearing disk with a small clearance therebetween, and a propeller fixed to the lower extremity of the rotary shaft to suck a liquid into the stirring unit and to urge the liquid toward the fixed shearing disk and the rotary shearing disk so as to be discharged from the stirring unit. The clearance between the fixed shearing disk and the rotary shearing disk is adjusted properly according to the properties of the liquid.

4 Claims, 4 Drawing Sheets

HOMOGENIZING MIXER

BACKGROUND OF THE INVENTION

1. Field of the Invention

The present invention relates to a homogenizing mixer for mixing the ingredients of paints, printing inks, foodstuffs, medicines and cosmetics.

2. Description of the Prior Art

FIG. 4 illustrates a conventional homogenizing mixer. This homogenizing mixer comprises stator rods a, a cylindrical stator b, a rotary shaft c extended coaxially in the stator b so as to be rotated at a high speed by a motor, not shown, a turbine d fixed to the free end of the rotary shaft c, and a deflecting plate h disposed above the stator b. The stator b is provided with a baffling section f consisting of radial baffles formed in the inner circumference of the lower portion thereof so as to surround the turbine d with a small gap therebetween, and a discharge bore g.

When the turbine d is rotated at a high speed in a tank, not shown, containing a liquid, the liquid is sucked through an opening formed in the bottom of the stator b into the same by the pumping action of the turbine d resulting from the pressure difference between the top and bottom of the turbine d, the liquid sucked into the stator b is stirred in turbulent flows by a high shearing force and an impulsive force generated by the rotation of the turbine d relative to the baffling section f, the stirred liquid is discharged upward through the discharge bore g against the deflecting plate h, and then the liquid is deflected by the deflecting plate h so as to flow downward along the inner surface of the tank. Thus, the liquid circulates in the tank and is stirred repeatedly.

However, this conventional homogenizing mixer is unable to stir the liquid uniformly and efficiently due to a high centrifugal force exerted on the liquid by the turbine.

SUMMARY OF THE INVENTION

Accordingly, it is an object of the present invention to provide a homogenizing mixer employing a novel shearing mechanism instead of such a turbine and capable of stirring a liquid uniformly and efficiently.

To achieve the object of the invention, the present invention provides a homogenizing mixer having a plurality of shearing disks disposed contiguously one over another and each having a plurality of through holes, characterized in that at least one of the plurality of shearing disks is rotated while a liquid is circulated through the homogenizing mixer.

BRIEF DESCRIPTION OF THE DRAWINGS

The above and other objects, features and advantages of the present invention will become apparent from the following description taken in conjunction with the accompanying drawings, in which.

DETAILED DESCRIPTION OF THE INVENTION

Figure 1:
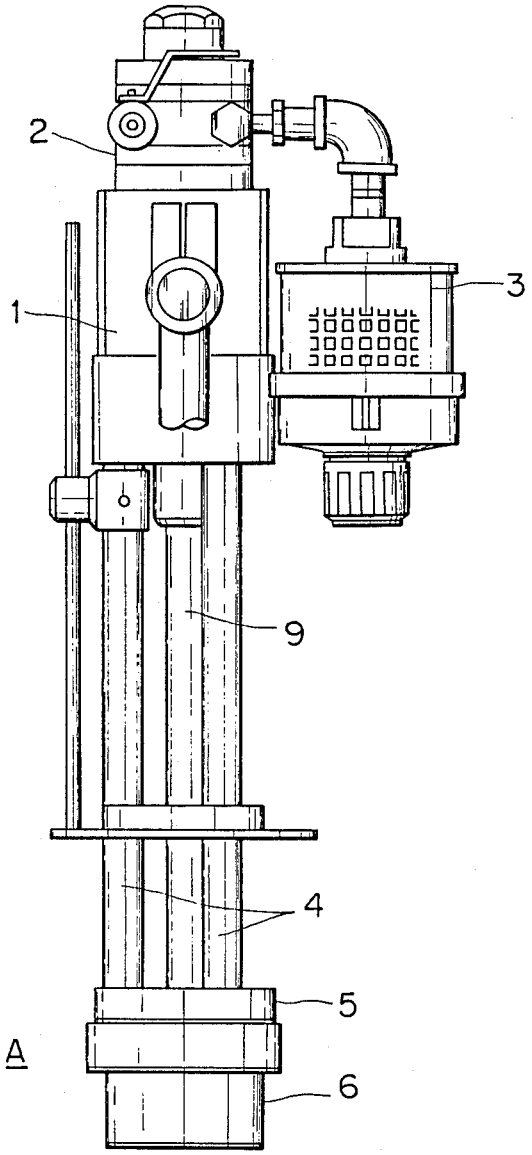
FIG. 1 is a front elevation of a homogenizing mixer embodying the present invention.

Referring to FIG. 1, a homogenizing mixer comprises a main unit 1, a pneumatic motor 2 mounted on top of the main unit 1, an exhaust muffler 3 connected to the pneumatic motor 2, and a stirring unit A fixedly connected to the main unit 1 by a plurality of supporting rods 4.

Figure 2:
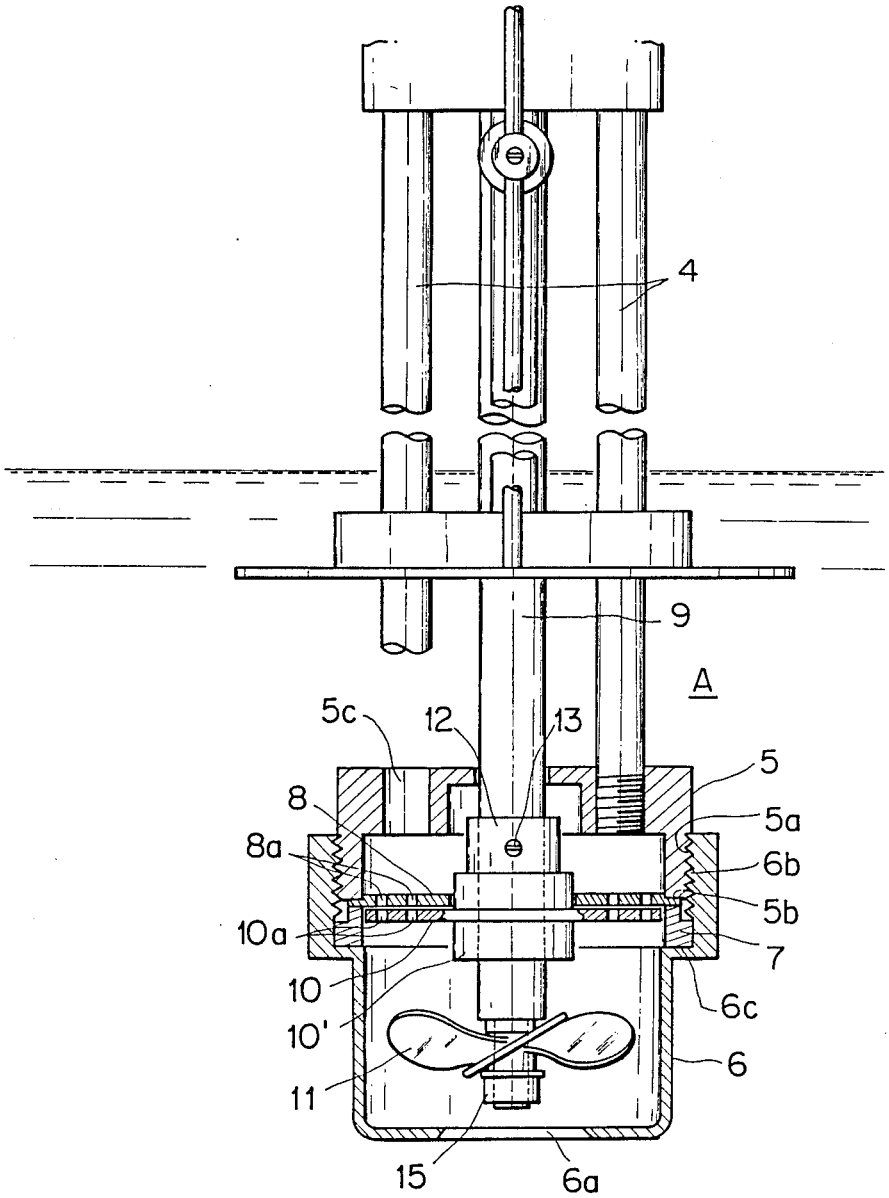
FIG. 2 is a longitudinal sectional view of the essential portion of the homogenizing mixer of FIG. 1.
Figure 3:
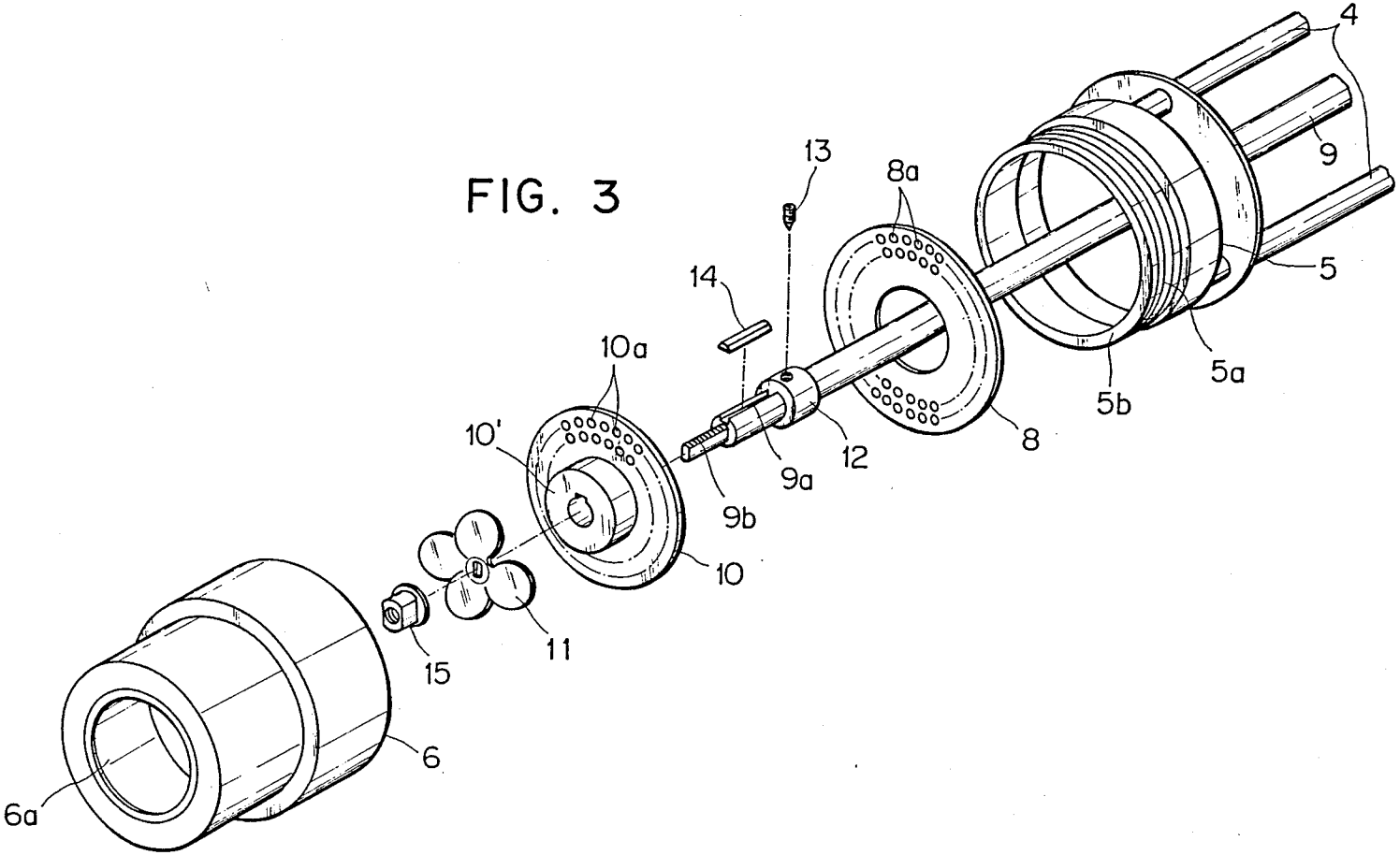
FIG. 3 is an exploded perspective view of the essential portion of the homogenizing mixier of FIG. 1.
Figure 4:
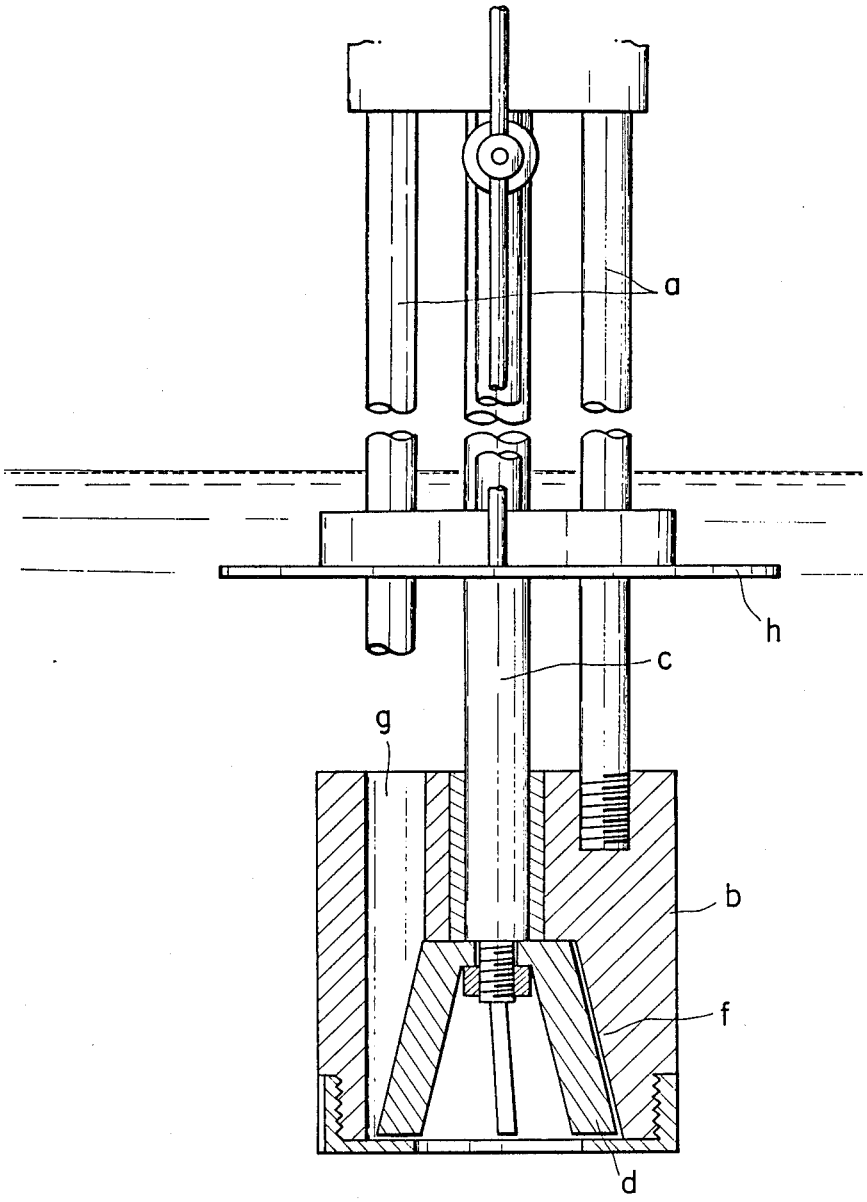
FIG. 4 is a longitudinal sectional view of the essential portion of a conventional homogenizing mixer.

Referring to FIGS. 2 and 3, the stirring unit A comprises a substantially cup-shaped upper casing 5 provided with discharge bores 5*c* in the upper wall thereof, a substantially cup-shaped lower casing 6 provided with a suction opening 6*a* in the bottom wall thereof, a packing 7, a fixed shearing disk 8 formed of a ceramic material and provided with a plurality of through holes 8*a* and a central through hole, a rotary shaft 9 operatively connected to the pneumatic motor 2 and having a lower end portion provided with a key seat 9*a*, and a reduced threaded extremity 9*b* extending from the lower end portion and having opposite flat surfaces and an external thread, a rotary shearing disk 10 formed of a ceramic material and provided with a plurality of through holes 10*a* and a boss 10′ having a central through hole provided with a key way, and a propeller 11 having a rectangualr central hole.

As best shown in FIG. 2, an external thread 5*a* is formed in the outer circumference of the lower part of the upper casing 5 and an internal thread 6*b* is formed in the inner circumference of the upper part of the lower casing 6 to join the upper casing 5 and the lower casing 7 fixedly by screwing the lower part of the upper casing 5 into the upper part of the lower casing 6 with the packing 7 and the fixed shearing disk 8 held between the lower end 5*b* of the upper casing 5 and the inner shoulder 6*c* of the lower casing 6. The rotary shaft 9 extends from the main body 1 into the interior of the stirring unit A through the central bore of the upper casing 5.

Within the stirring unit A, the rotary shearing disk 10 is mounted on the lower end portion of the rotary shaft 9 and the propeller 11 is mounted on the reduced extremity 9*b* of the rotary shaft 9. A fastening nut 15 is screwed on the reduced threaded extremity 9*b* of the rotary shaft 9 to fasten the rotary shearing disk 10 and the propeller 11 to the rotary shaft 9. An adjustable positioning ring 12 is fixed to the rotary shaft 9 with a stop screw 13 to decide the position of the rotary shearing disk 10 on the rotary shaft 9 so that the rotary shearing disk 10 is positioned contiguously below the fixed shearing disk 8. The rotary shearing disk 10 is restrained from rotation relative to the rotary shaft 9 by a key 14 engaging the key seat 9*a* formed in the lower end portion of the rotary shaft 9 and the key way formed in the boss 10′ of the rotary shearing disk 10.

The through holes 8*a* and 10*a* have a diameter in the range of 1 to 10 mm and are formed respectively in the fixed shearing disk 8 and the rotary shearing disk 10 so that the through holes 8*a* of the fixed shearing disk 8 are aligned respectively with the through holes 10*a* of the rotary shearing disk 10. Although the fixed shearing disk 8 and the rotary shearing disk 10 may be formed of a metallic material, it is preferable to form the shearing disk 8 and 10 of a ceramic material to obviate the adverse influence of metal ions on the liquid to be stirred. The clearance between the fixed shearing disk 8 and the rotary shearing disk 10 is dependent on the properties of the liquid to be stirred and is in the range of 0.1 to 5 mm. The smaller the clearance, the greater is the shearing force that acts on the liquid. A deflecting plate 16 is provided on the supporting rods 4 above the stirring unit A.

In operation, the homogenizing mixer is disposed with the stirring unit A immersed in a liquid contained in a tank, not shown, and then the rotary shaft 9 is driven for rotation by the pneumatic motor 2 to rotate the rotary shearing disk 10 and the propeller 11. Then, the liquid is sucked through the suction opening 6a of the lower casing 6 into the stirring unit A and is urged toward the rotary shearing disk 10 and the fixed shearing disk 8 by the propeller 11. The liquid is subjected to the shearing action of the rotary shearing disk 10 and the fixed shearing disk 8 the flows through the through holes 10a of the rotary shearing disk 10 and the through holes 8a of the fixed shearing disk 8. The liquid thus sheared between the fixed shearing disk 8 and the rotary shearing disk 10 is discharged upward through the discharge bores 5c from the stirring unit A, and then the liquid is deflected downward by the deflecting plate 16, so that the liquid circulates through the stirring unit A within the tank.

In a modification, another rotary shearing disk is provided over the fixed shearing disk 8.

Thus, the homogenizing mixer of the present invention applies a shearing force uniformly to the liquid between the plurality of shearing disks disposed contiguously one over the other with a fixed small clearance therebetween by rotating at least one of the shearing disks while the liquid is circulated through the stirring unit, and thereby the liquid is stirred uniformly and efficiently to homogenize the liquid.

Although the invention has been described with a certain degree of particularity, obviously many changes and variations are possible therein. It is threfore to be understood that the invention may be practiced otherwise than specifically described herein without departing from the scope and spirit thereof.

What is claimed is:

1. A homogenizing liquid mixer, comprising:

a casing having communication hole means on opposing walls thereof and a central hole in one of said opposing walls;

means for supporting said casing;

a rotary shaft connected to a drive source and extending inside and outside said casing through said central hole;

a propeller attached to said rotary shaft within said casing;

a first shearing disk means provided within said casing between said opposing walls for partitioning said opposing walls; and a second shearing disk means attached to said rotary shaft for facing said first shearing disk means in close proximity of said first shearing disk means, said first and second shearing disk means having a plurality of through holes passing therethrough and being for further stirring and homogenizing said liquid.

2. A homogenizing mixer according to claim 1, wherein said through holes of said first and second shearing disk means are aligned, respectively.

3. A homogenizing mixer according to claim 1, wherein said shearing disk means are formed of a ceramic material.

4. A homogenizing mixer according to claim 1, wherein said shearing disk means are formed of a metallic material.

* * * * *